United States Patent [19]

Eckert

[11] 4,009,986

[45] Mar. 1, 1977

[54] AIR CONTROL VALVE FOR EXHAUST GAS PURIFYING APPARATUS

[75] Inventor: Konrad Eckert, Stuttgart-Feuerbach, Germany

[73] Assignee: Robert Bosch G.m.b.H., Stuttgart, Germany

[22] Filed: May 12, 1975

[21] Appl. No.: 576,265

Related U.S. Application Data

[62] Division of Ser. No. 322,861, Jan. 11, 1973, Pat. No. 3,945,802.

[30] Foreign Application Priority Data

Jan. 14, 1972 Germany ..... 2201739

[52] U.S. Cl. ..... 431/90; 23/277 C; 137/100; 431/12

[51] Int. Cl.[2] ..... F23H 1/02

[58] Field of Search ..... 431/90, 12; 251/335 A; 137/99, 100, 483, 500; 23/277 C

[56] References Cited

UNITED STATES PATENTS

| | | | |
|---|---|---|---|
| 2,394,297 | 2/1946 | Fayles | 431/90 X |
| 2,395,384 | 2/1946 | Ziebolz | 431/90 X |
| 3,209,811 | 10/1965 | Strang | 431/90 |
| 3,827,849 | 8/1974 | Nelson | 431/90 |

*Primary Examiner*—Edward G. Favors
*Attorney, Agent, or Firm*—Edwin E. Greigg

[57] ABSTRACT

In an exhaust gas purifying apparatus which includes a reactor in the exhaust line of an internal combustion engine there is provided a heater burner to which there is delivered an air-fuel mixture and which heats the reactor for rapidly bringing it to operating temperatures when the engine is started. In the air conduit through which combustion air for the air-fuel mixture is delivered to the burner there is provided a valve controlled in such a manner that the flow rate of combustion air remains constant and is thus independent of the said counterpressure at the heating burner and the output delivery of the air pump driving the combustion air.

4 Claims, 1 Drawing Figure

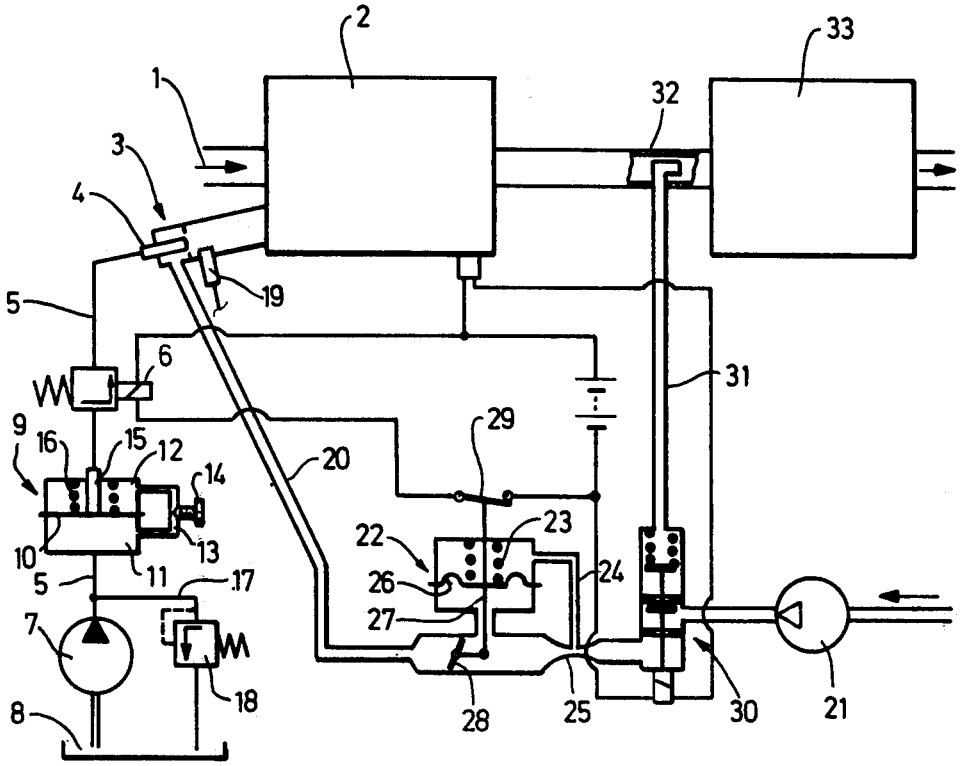
2
33
1
32
3
4
19
5
6
31
9
16
15
12
29
14
20
22
23
10
13
26
24
5
11
17
27
7
18
8
28
25
30
21

AIR CONTROL VALVE FOR EXHAUST GAS PURIFYING APPARATUS

CROSS REFERENCE TO RELATED APPLICATION

This application is a division of applicant's copending application Ser. No. 322,861 filed on Jan. 11, 1973 now U.S. Pat. No. 3,945,802.

BACKGROUND OF THE INVENTION

This invention relates to an apparatus for purifying the exhaust gases of internal combustion engines and is of the type which is provided with at least one reactor and a heating burner, both disposed in the exhaust line of the engine, and more particularly to an air control valve used with such an apparatus.

Exhaust gases of internal combustion engines contain, among others, carbon monoxide, oxides of nitrogen and uncombusted or partially combusted hydrocarbons which contribute to a substantial extent to air pollution.

A known exhaust gas purifying apparatus of the aforeoutlined type (such as disclosed, for example, in German Pat. No 470,389) utilizes three measures: first, the exhaust gases are mixed with an oxidizing agent, second, the combustion of the gases is initiated by means of an external heat source and third, the aforenamed combustion is continued and maintained by heat which is derived from the burning gases by means of a catalyzer. This known apparatus comprises a combustion chamber into which leads the exhaust conduit of the engine and an air chamber which surrounds the combustion chamber. Upstream of the combustion chamber in the exhaust conduit there is disposed a catalyzer upstream of which there is arranged a spark plug and an injector which, dependent upon the position of associated valves, selectively draws an air-hydrocarbon mixture or preheated air into the exhaust conduit. When the internal combustion engine is started, the catalyzer is heated over the ignited hydrocarbon mixture. After the combustion chamber has reached a certain temperature that is sufficient to bring the temperature of the air in the air chamber to a predetermined value, the admission of the hydrocarbon mixture is interrupted and the preheated air is mixed to the exhaust gas flow. The harmful pollutants of the latter are then converted with the cooperation of the catalyzer while the catalyzer temperature is maintained.

The ever increasing limitations imposed by law on the poisonous components in the exhaust gas of internal combustion engines require to improve the aforeoutlined heating in such a manner that the period in which the necessary operational temperature of the exhaust gas purifying apparatus is reached, is substantially shortened. This is of great significance because, according to the future test methods the emissions are measured from the time of engine start and the test cycles begin to run as early as the start of the internal combustion engine. Thus, during the warm run of the engine, even the emission of poisonous exhaust gas components by the heating burner are included in the test results.

OBJECT AND SUMMARY OF THE INVENTION

It is an object of the invention to provide an improved exhaust gas purifying apparatus including an air control valve which produces optimal exhaust gas values as early as the period of the warm-up run of the internal combustion engine.

Briefly stated, according to the invention, the air quantities delivered to the heating burner are adjustable to a constant value by an air control valve independently from the counterpressure at the heating burner and the output of the air pump.

The invention will be better understood as well as further objects and advantages become more apparent from the ensuing detailed specification of a preferred, although exemplary embodiment of the invention taken in conjunction with the sole FIGURE schematically illustrating the exhaust gas purifying apparatus incorporating the invention.

DESCRIPTION OF THE PREFERRED EMBODIMENT

Turning now to the FIGURE, in the exhaust gas purifying apparatus shown therein the exhaust gas flows in the direction of the arrow 1 from an internal combustion engine (not shown) into a reactor 2 which may be of the type that is provided with a heat storing material or a catalyzer material and which serves, for example, for the reduction of nitrogen oxide. For heating the reactor 2 to the operating temperature there is provided a heating burner 3, the fuel nozzle 4 of which is connected to a burner fuel conduit 5 which, during the stand-still of the internal combustion engine or upon termination of the warm-up run, is closed by a solenoid valve 6. A fuel pump 7 draws fuel from a fuel tank 8 and forces it through the burner fuel conduit 5. The flow rate of the fuel to the fuel nozzle 4 is settable to a constant value by means of a fuel control valve 9. The latter contains a diaphragm 10 which separates the chambers 11 and 12 from one another. The chambers 11 and 12 are interconnected by means of a channel 13, the flow passage section of which is variable by means of an adjustable throttle screw 14. The fuel control valve 9 is formed as a flat seat valve having the diaphragm 10 as its movable valve member and also having a stationary valve seat 15. When the heating burner 3 is not operating, a spring 16 maintains the fuel control valve 9 in its open position. From the burner fuel conduit 5, at the pressure side of the fuel pump 7, there extends a return conduit 17 which contains a pressure limiting valve 18 and which leads back to the fuel tank 8.

The supply of air to the heating burner 3 is effected through a burner air conduit 20 by means of an air pump 21. For the ignition of the fuel-air mixture at the heating burner 3 there is disposed, in the vicinity thereof, a spark plug 19. The air flow in the burner air conduit 20 is maintained at a constant value by means of an air control valve 22. For this purpose, in addition to a spring 23, one side of a diaphragm 26 is exposed, through a channel 24, to the air pressure in the smallest flow passage section of a venturi nozzle 25. The other side of the diaphragm 26 is exposed to the air pressure in the burner air conduit 20 downstream of the venturi nozzle 25. The diaphragm 26 operates, by means of a linkage 27, a butterfly valve 28 disposed in the burner air conduit and, at the same time, also actuates a switch 29 which is located in the energizing circuit (not shown in detail) of the solenoid valve 6.

Downstream of the air pump 21 there is located an electromagnetically controlled air control valve 30 which is controlled by a temperature sensor 34 and which permits an air flow in the burner air conduit 20 during the warm-up run of the engine until the operating temperature of the reactor is reached. Upon such an occurrence the air control valve 30 interrupts the air flow effected by the air pump 21 through the burner air conduit 20 and at the same time deflects the air stream into the secondary air conduit 31 which has been closed heretofore. The secondary air conduit 31 merges into an intermediate pipe 32 of the exhaust gas conduit downstream of the reactor 2. The intermediate pipe 32 leads into a further reactor 33 in which there is effected, for example, the oxidation of carbon monoxide and uncombusted or only partially combusted hydrocarbons.

The exhaust gas purifying apparatus described above operates in the following manner.

In order to obtain a reaction-ready reactor for the purifying process as soon after the starting of the engine as possible, upstream of the reactor 2 there is connected the heating burner 3 which heats the reactor 2 to the operating temperature. According to the invention in the heating burner 3 there is ignited, by means of the spark plug 19, a constant fuel-air mixture. The combustion air for the heating burner 3 flows during the heat-up phase of the reactor 2 through the burner air conduit 20, since the air control valve 30, responding to the temperature sensor, maintains communication between the air pump 21 and the burner air conduit 20, while it blocks communication between the air pump 21 and the auxiliary air conduit 31. In order to ensure that independently from the counterpressure at the heating burner 3 and independently from the output of the air pump 21 there is metered a constant air quantity, in the burner air conduit 20 there is disposed the butterfly valve 28 which is controlled by means of the diaphragm 26 as a function of the air quantities or pressure difference at the venturi tube 25. If the actual throughgoing air quantities are smaller than the desired air quantities required for the combustion at the heating burner, the butterfly valve 28 is maintained in its open position through the linkage 27 by the spring 23 and simultaneously the engergizing circuit of the solenoid valve 6 is maintained open by means of switch 29. If the air quantities in the burner air conduit 20 fall below a predetermined value, then the fuel flow to the heating burner 3 is immediately stopped. The solenoid valve 6 operates advantageously with a delay when energized, but without delay when de-energized.

In order to ensure that for the constant burner air quantities there are simultaneously metered constant burner fuel quantities, in the burner fuel conduit 5 there is located the fuel regulating valve 9 which operates as a diaphragm-type differential pressure valve. The fuel quantities flowing through the outlet of the valve 9 can be set by means of the throttle screw 14. Thus, either by changing the spring bias 23 at the air control valve 22 or by changing the position of the throttle 14 at the fuel control valve 9 there may be set a fuel-air mixture which during the combustion effected by virtue of the heating burner 3 results in an exhaust gas which is approximately free of harmful pollutants.

Once the reactor 2 has reached its operating temperature, the temperature sensor 34 readjusts the air control valve 30 in such a manner that it shuts off the air flow in the burner air conduit 20 and simultaneously opens the heretofore closed secondary air conduit 31 to the air pump 21 to make possible a further oxidation of the carbon monoxide and the uncombusted or partially combusted hydrocarbons in the reactor 33.

What is claimed is:

1. In combination, a heating burner for heating a reactor of an exhaust gas purifying apparatus to operating temperatures, fuel supply means for delivering burner fuel to said heating burner, said fuel supply means including a fuel conduit, air supply means for delivering combustion air to said heating burner, said air supply means including a burner air conduit and an air pump disposed in the latter, and an air control valve, the air control valve including:

a. a movable valve member situated in said burner air conduit downstream of said air pump; and b. regulating means coupling to said movable valve member for regulating the air quantities delivered to said heating burner to a constant value independently from the counterpressure at said heating burner and independently from the output delivery of said air pump, said regulating means including:

i. venturi nozzle disposed in said burner air conduit upstream of said movable valve member, said venturi nozzle having a narrowest flow passage section;

ii. a diaphragm having first and second sides;

iii. linkage means connecting said diaphragm with said movable valve member;

iv. means for communicating the pressure prevailing in said narrowest flow passage section with said first side of said diaphragm;

v. a spring means in engagement with said first side of said diaphragm; and vi. means for communicating the pressure prevailing in said burner air conduit downstream of said venturi nozzle and upstream of said movable valve member with said second side of said diaphragm.

2. In combination, a heating burner for heating a reactor of an exhaust gas purifying apparatus to operating temperatures, fuel supply means for delivering burner fuel to said heating burner, said fuel supply means including a fuel conduit, a fuel regulating valve having means for setting the throughgoing fuel quantities to a constant value, air supply means for delivering combustion air to said heating burner, said air supply means including a burner air conduit and an air pump disposed in the latter, and an air control valve, with the air control valve including:

a. a movable valve member situated in said burner air conduit downstream of said air pump; and b. regulating means coupled to said movable valve member for regulating the air quantities delivered to said heating burner to a constant value independently from the counterpressure at said heating burner and independently from the output delivery of said air pump, and with the fuel regulating valve being formed as a diaphragm-type pressure differential valve having:

a. first and second chambers;

b. a diaphragm constituting a movable valve member of said pressure differential valve and separating said first and second chambers from one another;

c. channel means maintaining communication between said first and second chambers; and d. adjustable throttle means in said channel means for varying the flow passage section thereof.

3. The combination as defined in claim 1, wherein said movable valve member is constituted by a butterfly valve.

4. The combination as defined in claim 1, including:

a. a solenoid valve in said fuel conduit;

b. an electric energizing circuit connected to said solenoid valve;

c. an on-off switch in said electric energizing circuit to close and open the latter; and d. means for connecting said diaphragm with said on-off switch, whereby said fuel conduit is shut off by means of said solenoid valve when the air quantities flowing through said burner air conduit fall below a predetermined value.

* * * * *